US010676697B2

(12) United States Patent
Sankarakumara Pillai et al.

(10) Patent No.: US 10,676,697 B2
(45) Date of Patent: Jun. 9, 2020

(54) BIODEGRADABLE DETERGENT COMPOSITION

(71) Applicants: PROKLEAN TECHNOLOGIES PVT. LTD, Chennai (IN); SUSTAINABLE COMMUNITY DEVELOPMENT, LLC, Kansas City, MO (US)

(72) Inventors: Sivaramakrishna Pillai Sankarakumara Pillai, Chennai (IN); Chandrasekhar B., Chennai (IN); Matthew T. Wood, Kansas City, MO (US); Narin Tipsrisukond, Kansas City, MO (US)

(73) Assignees: PROKLEAN TECHNOLOGIES PVT. LTD, Chennai (IN); SUSTAINABLE COMMUNITY DEVELOPMENT, LLC, Kansas City, MO (US)

( * ) Notice: Subject to any disclaimer, the term of this patent is extended or adjusted under 35 U.S.C. 154(b) by 71 days.

(21) Appl. No.: 16/062,039

(22) PCT Filed: Dec. 16, 2016

(86) PCT No.: PCT/IN2016/050445
§ 371 (c)(1),
(2) Date: Jun. 13, 2018

(87) PCT Pub. No.: WO2017/103947
PCT Pub. Date: Jun. 22, 2017

(65) Prior Publication Data

US 2018/0371372 A1 Dec. 27, 2018

(30) Foreign Application Priority Data

Dec. 17, 2015 (IN) ..... 6941/CHE/2015

(51) Int. Cl.
*C11D 3/38* (2006.01)
*C11D 3/20* (2006.01)
(Continued)

(52) U.S. Cl.
CPC ..... *C11D 3/381* (2013.01); *C11D 3/2065* (2013.01); *C11D 3/2075* (2013.01); *C11D 3/382* (2013.01);
(Continued)

(58) Field of Classification Search
CPC ..... C11D 11/0017; C11D 11/0094; C11D 3/2065; C11D 3/2075; C11D 3/381; C11D 3/382; C11D 3/386
See application file for complete search history.

(56) References Cited

U.S. PATENT DOCUMENTS 4,357,254 A * 11/1982 Kapiloff ..... B01D 61/10 510/162
6,376,445 B1 4/2002 Bettiol et al.
(Continued)

FOREIGN PATENT DOCUMENTS

WO 2010108000 A1 9/2010

OTHER PUBLICATIONS

International Search Report & Written Opinion dated Mar. 30, 2017 from PCT Application No. PCT/IN2016/050445.

*Primary Examiner* — Mark Kopec
*Assistant Examiner* — Jaison P Thomas
(74) *Attorney, Agent, or Firm* — Innovation Capital Law Group, LLP; Vic Lin

(57) ABSTRACT

The present invention relates to a biodegradable detergent composition, which can contain viable cells or enzymes and acts as a replacement for the chemical detergents. The biodegradable detergent composition, comprising of: bio surfactant; polyols; biopolymer; organic acid; small chain
(Continued)

peptide; essential oil; and stabilizers. The biodegradable detergent composition has a pH value of less than about 3.60, Titratable Acidity % between about 9.0-12.0, HLB value between about 14 to about 16.5, E24 value between about 73 and about 79. The biodegradable detergent composition has MALDI-TOF MS spectra in the m/z range from about 513.1 to about 2847.7 with peak mass value range from about 1375.8 m/z to about 2009.2 m/z. Further, the present invention relates to a method of manufacturing the biodegradable detergent composition.

20 Claims, 5 Drawing Sheets

(51) Int. Cl.
*C11D 3/382* (2006.01)
*C11D 11/00* (2006.01)
*C11D 3/386* (2006.01)

(52) U.S. Cl.
CPC ..... *C11D 3/386* (2013.01); *C11D 11/0017* (2013.01); *C11D 11/0094* (2013.01)

(56) References Cited

U.S. PATENT DOCUMENTS

| | | | | |
|---|---|---|---|---|
| 2003/0089381 | A1 | 5/2003 | Manning | |
| 2007/0241306 | A1 | 10/2007 | Wehner et al. | |
| 2012/0021963 | A1* | 1/2012 | Kneipp | C23G 1/24 510/259 |
| 2017/0240845 | A1* | 8/2017 | Harris | C11D 3/2079 |

* cited by examiner

BIODEGRADABLE DETERGENT COMPOSITION

FIELD OF INVENTION

The present invention relates to a detergent composition. More particularly, the present invention relates to a biodegradable detergent composition, which can contain viable cells or enzymes and acts as a replacement for the chemical detergents. Further, the present invention relates to a method of manufacturing the biodegradable detergent composition.

BACKGROUND OF INVENTION

Most washing operations both domestic and commercial employ chemical detergents. The wash water is ultimately released into large water bodies. It is common knowledge that chemical detergents increase the COD of water resulting in depletion of dissolved oxygen and harm to aquatic life.

Previously, preparations have been created wherein probiotics augment the detergent or washing functions, but do not replace them.

Accordingly, there exists a need for a biodegradable detergent composition, which can contain viable cells or enzymes and acts as a replacement for the chemical detergents.

OBJECTS OF INVENTION

One or more of the problems/limitations of the conventional prior art may be overcome by various embodiments of the present invention.

One object of the present invention is to provide a biodegradable detergent composition, which can contain viable cells or enzymes and acts as a replacement for the chemical detergents.

It is another object of the present invention to provide a biodegradable detergent composition, which is free of phosphates, is non-toxic, and made from probiotic organism(s).

It is another object of the present invention to provide a biodegradable detergent composition, which has a pH value of less than about 3.60, Titratable Acidity % between about 9.0-12.0, HLB value between about 14 to about 16.5, and E24 value between about 73 and about 79.

It is another object of the present invention to provide a biodegradable detergent composition, which has MALDI-TOF MS spectra in the m/z range from about 513.1 to about 2847.7 with peak mass value range from about 1375.8 m/z to about 2009.2 m/z.

It is another object of the present invention to provide a method of manufacturing the biodegradable detergent composition.

SUMMARY OF THE INVENTION

Thus according to the basic aspect of the present invention, there is provided a biodegradable detergent composition, comprising:

- bio surfactant;
- polyols;
- biopolymer;
- organic acid;
- small chain peptide;
- essential oil; and
- stabilizers,
- wherein the biodegradable detergent composition has a pH value of less than about 3.60, Titratable Acidity % between about 9.0 to about12.0, HLB value between about 14 to about 16.5, and E24 value between about 73 and about 79.

It is another aspect of the present invention, wherein the biodegradable detergent composition has MALDI-TOF MS spectra in the m/z range from about 513.1 to about 2847.7 with peak mass value range from about 1375.8 m/z to about 2009.2 m/z.

Another aspect of the present invention is directed to provide a method of manufacturing the biodegradable detergent composition, comprising:

- fermenting at least one starting culture probiotic organism through a medium which is an energy source as carbon source;
- adding emulsifiers or detergents to the medium as fermentation enhancers or additives;
- adding natural vegetable oils to the medium once it reaches a pH value of 4.0 to obtain a fermented product;
- mixing essential oils either alone or in combination along with the emulsifiers or detergents with the fermented product; and
- adding stabilizers either alone or in combination along with the fermented product,
- wherein the fermentation is continued until the desired value of pH, titratable acidity, HLB value and E24 values,
- wherein the emulsifiers or detergents are added in the range of about 0.05 to about 0.15%,
- wherein the natural vegetable oils are added in the range of about 0.05 to about 5% of the total volume of broth, and
- wherein the stabilizers are added at a concentration of about 0.5 to about 3.0% to render the detergent composition stable with a long shelf life.

The present invention is directed to compositions containing and methods using microorganisms. In particular, the present invention is directed to a composition containing at least 3 microorganisms. At least one microorganism is a sulfide-utilizing microorganism. Additional microorganisms include lactic acid, probiotic, and phototrophic microorganisms, as well as mixtures thereof. Microorganisms may be bacteria, yeast, fungi, or mold species or mixtures thereof.

It is another aspect of the present invention, wherein the probiotic organisms includes at least one species of microorganisms from lactic acid, probiotic, phototrophic, and sulfide-utilizing microorganism species. In another embodiment, the included sulfide-utilizing microorganisms is a purples non-sulfur bacteria species. Examples of the probiotic organisms includes *Bifidobacterium, Lactobacillus, Lactococcus, Bacillius, Saccharomyces, Rhodopseudomonas,* and combinations thereof.

The composition of the present invention may include fermentation enhancers or additives. Such enhancers or additives may support growth of microorganisms, induce production of specific metabolites by microorganisms, enhance the stability of the composition, and provide other attributes to the composition of the invention. Suitable additives include a carbon source, acids, and other additives known in the art to support growth, induce specific metabolite production, or stabilize the composition. Examples of such enhancers or additives includes fruit juices, unrefined cane sugar, beet sugar, molasses or natural sugar source, the emulsifiers or detergents, natural vegetable oil either alone or in combination with other.

It is another aspect of the present invention, wherein the essential oil is mixed with the fermented product in the range of about 0.05 to about 5% of the total volume of the broth.

It is another aspect of the present invention, wherein the essential oil includes lavender oil, lemon oil, lemon grass oil, or combinations thereof.

It is another aspect of the present invention, wherein the fermentation is carried out at ambient temperature ranging from about 17° C. to about 45° C. for a period of 14-42 days.

Yet another object of the invention is to have a composition relating to the present invention that is completely phosphate free, non-toxic, may contain live microorganisms and fully bio-degradable and is thus a green technology for washing.

BRIEF DESCRIPTION OF THE ACCOMPANYING GRAPHS

DETAILED DESCRIPTION OF THE INVENTION WITH REFERENCE TO THE ACCOMPANYING GRAPHS

Figure 1:
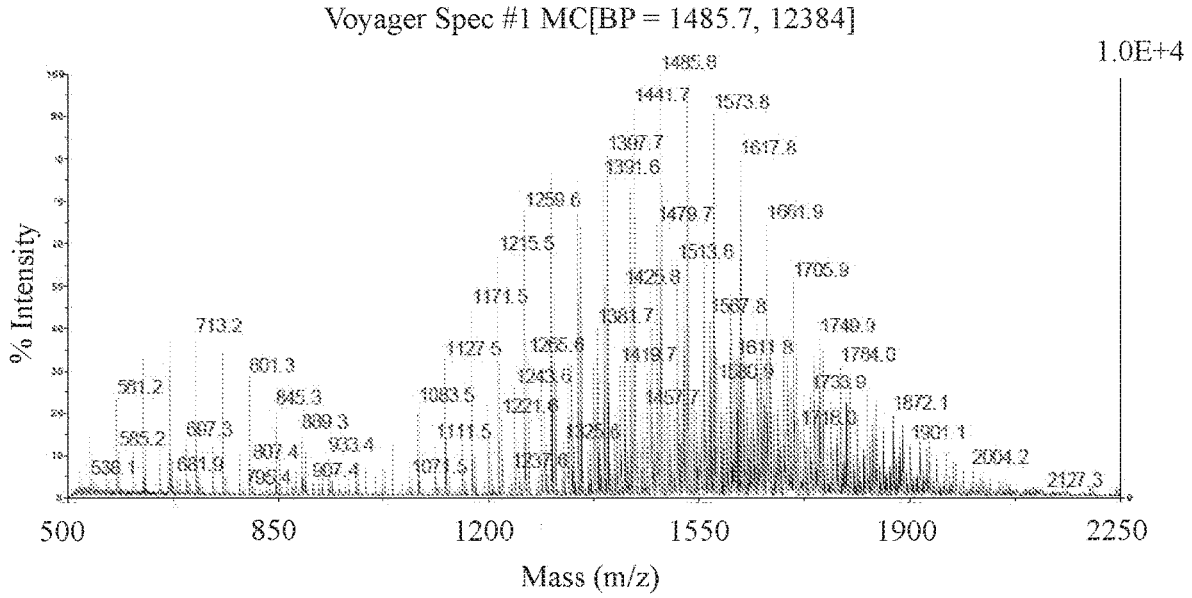
FIG. 1 illustrates the MALDI-TOF profile of biodegradable detergent composition according to the present invention.
Figure 2:
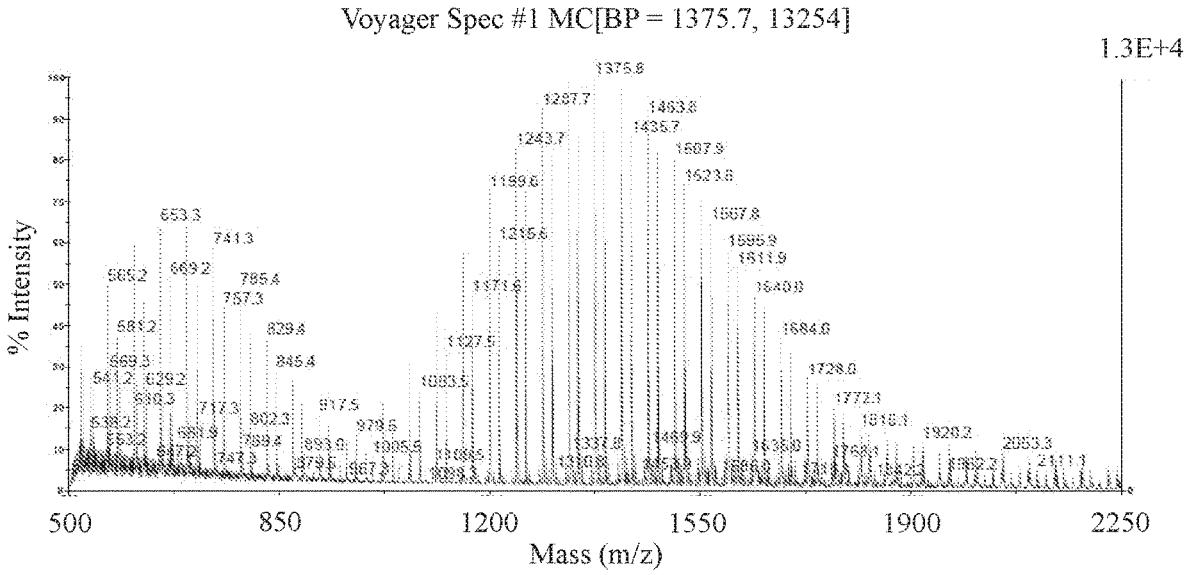
FIG. 2 illustrates the MALDI-TOF profile of biodegradable detergent composition according to the present invention.
Figure 3:
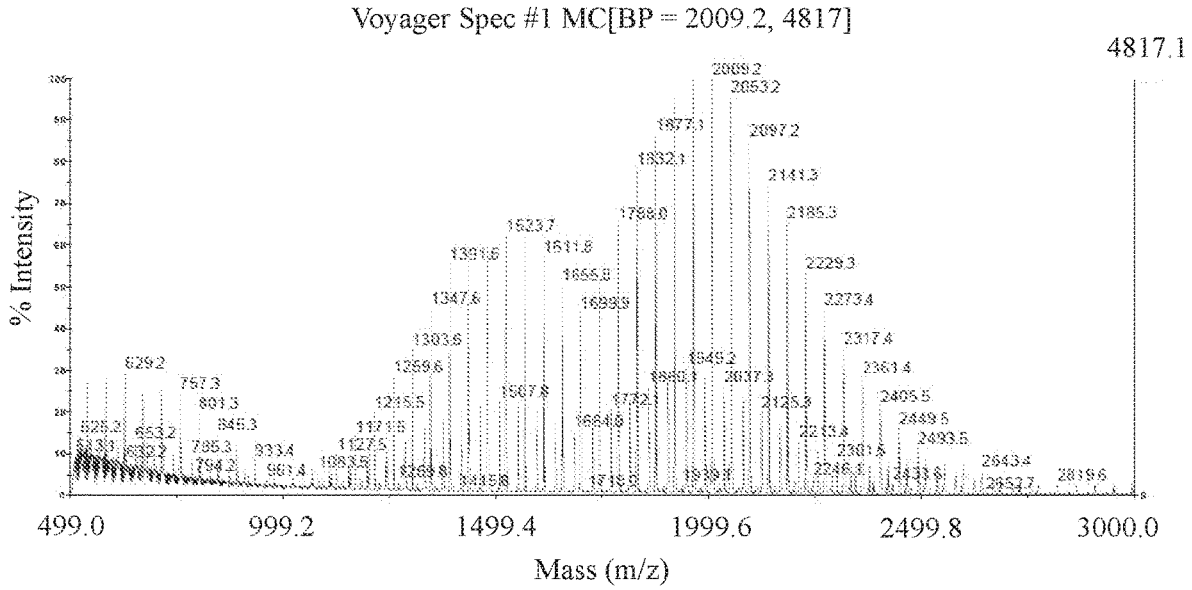
FIG. 3 illustrates the MALDI-TOF profile of biodegradable detergent composition according to the present invention.
Figure 4:
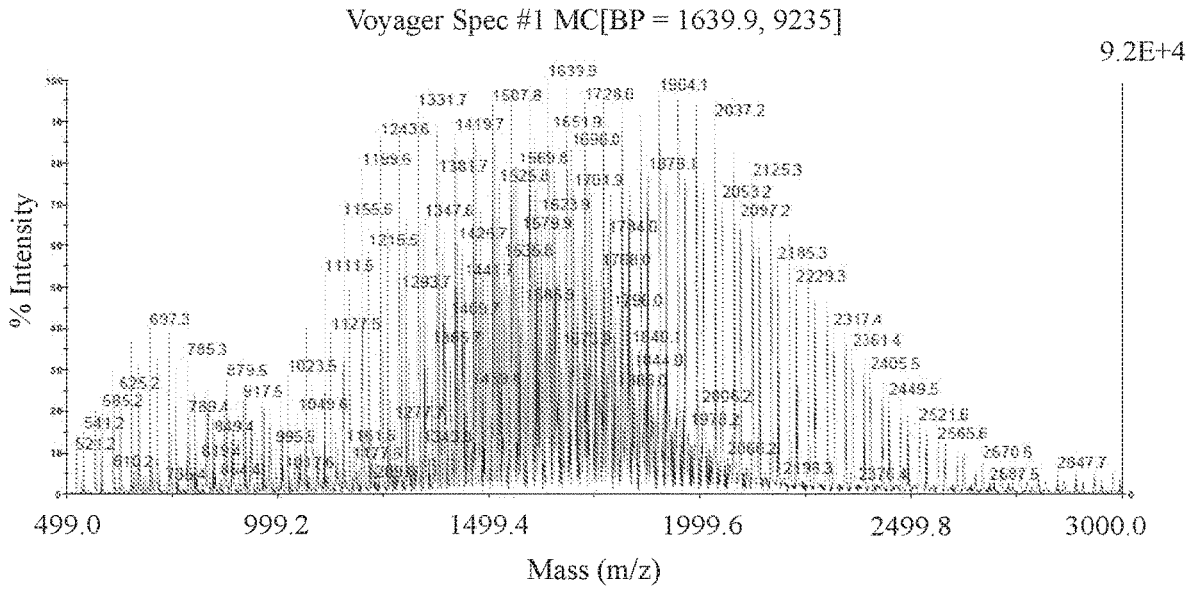
FIG. 4 illustrates the MALDI-TOF profile of biodegradable detergent composition according to the present invention.
Figure 5:
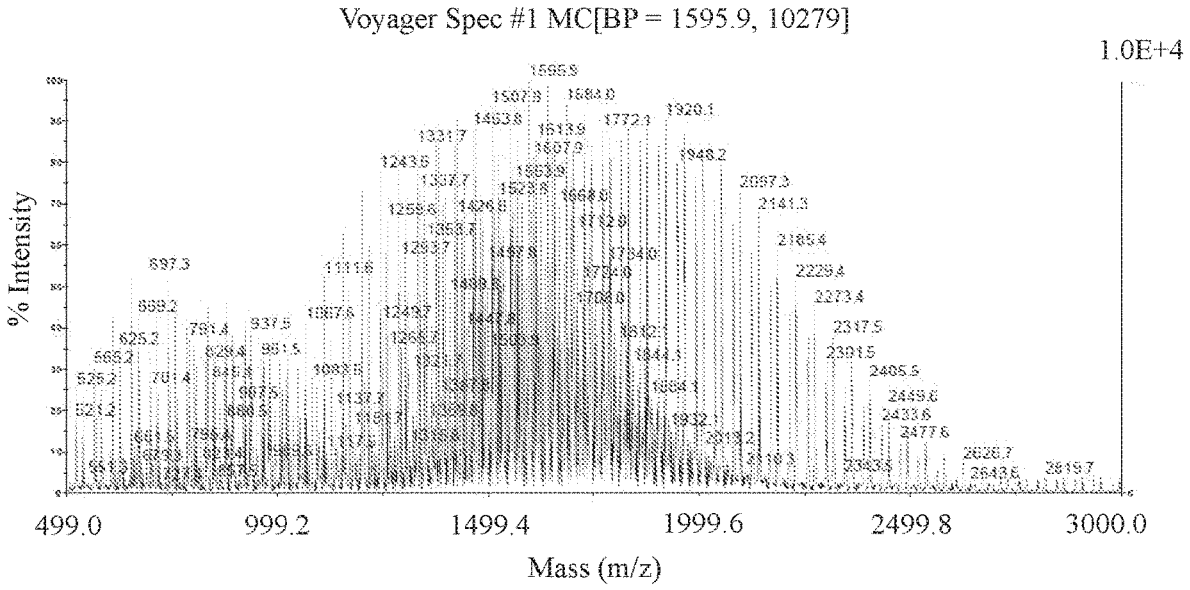
FIG. 5 illustrates the MALDI-TOF profile of biodegradable detergent composition according to the present invention.

The present invention relates to a biodegradable detergent composition, which can contain viable cells or enzymes and acts as a replacement for the chemical detergents. Further, the present invention relates to a method of manufacturing the biodegradable detergent composition.

The biodegradable detergent composition, comprising of: bio surfactant; polyols; biopolymer; organic acid; small chain peptide; and essential oil. The biodegradable detergent composition has a pH value of less than about 3.60, Titratable Acidity % between about 9.0-12.0, HLB value between about 14 to about 16.5, E24 value between about 73 and about 79.

A method of manufacturing the biodegradable detergent composition comprises steps of: at least one starting culture probiotic organism is fermented through a medium, which contains energy source, fermentation enhancers and additives. Emulsifiers or detergents are added to the medium as fermentation enhancers or additives, said emulsifiers or detergents are added in the range of about 0.05 to about 0.15%. Natural vegetable oils are added to the medium once it reaches a pH value of about 4.0 to obtain a fermented product. The natural vegetable oils are added in the range of about 0.05 to about 5% of the total volume of broth. Essential oils are mixed either alone or in combination along with the fermentation emulsifiers or detergents with the fermented product. The essential oil is mixed with the fermented product in the range of about 0.05 to about 5% of the total volume of the broth. The fermentation is continued until the desired value of pH, titratable acidity, HLB value and E24 values. Stabilizers are added either alone or in combination along with the fermented product, said stabilizers are added at a concentration of about 0.5 to about 3.0% to render the detergent composition stable with a long shelf life The fermentation is carried out at ambient temperature ranging from about 17° C. to about 45° C. for a period of 14-42 days. By opting to carry out the fermentation at the ambient temperature without any heating or cooling to maintain a constant temperature, the manufacturing process is made environment friendly. Overall, the entire manufacturing process is aimed at reducing the carbon footprint compared to traditional manufacturing processes adopted for detergents used for similar application.

The probiotic organism includes at least one species of microorganisms from lactic acid, probiotic, phototrophic, and sulfide-utilizing microorganism species. In another embodiment, the included sulfide-utilizing microorganisms is a purples non-sulfur bacteria species. Examples include *Bifidobacterium, Lactobacillus, Lactococcus, Bacillius, Saccharomyces, Rhodopseudomonas,* and combinations thereof.

The energy source, fermentation enhancers or additives includes fruit juices, unrefined cane sugar, beet sugar, molasses or natural sugar source, emulsifiers or detergents, the natural vegetable oil and the essential oil such as lavender oil, lemon oil and lemon grass oil.

Also herein are compositions comprising the biodegradable detergent composition, which are essentially free of any chemical detergents. In other words, the conventional chemical detergents in the have been replaced.

Methods of using the biodegradable detergent composition very similar to those currently practiced for use of liquid chemical detergent compositions, such as dispensing manually or through a dispensing program of washing machines, or hand wash methods currently practiced in consumer or commercial settings are also contemplated herein. The biodegradable detergent composition may be used in any washing, cleaning and/or textile care methods, including soaking methods, pre-treatment methods, and the like. For example, methods would involve contacting a textile or fabric with the biodegradable detergent composition for an effective amount of time to remove dirt/debris, soils, stains, oils, grease, and generally clean the textile. In particular, an effective amount of the biodegradable detergent composition, optionally in water, could be dispensed into a washing container that contains the textile or fabric to be cleaned. Exemplary washing containers include commercial or residential washing machines, as well as hand washing wash tubs.

For Illustration

Test Results

1. MALDI-TOF Spectrum Analysis

Two Matrix-assisted laser desorption/ionization (MALDI) matrices were used for the study, α-cyano-4 hydroxycinnamic acid (CHCA) and sinapic acid (SA). Both matrices were prepared at approx 10 mg/mL in 50/50 acetonitrile/water with 0.3% trifluoroacetic acid. Samples were diluted 1/20 in CHCA matrix and 0.5 μL of each diluted sample was spotted on a stainless steel MALDI plate. Molecular weight cut-off spin filters were used to remove the sample components either less than 3,000 Da or less than 10,000 Da with a sample load of 100 μL. The concentrated high molecular weight samples (10 μL) were diluted 1/30 and 0.5 μL of each diluted sample was spotted on a stainless steel MALDI plate.

The fermentation products were analyzed for their fingerprint characterization using a Voyager DE STR Matrix-assisted laser desorption/ionization—Time of Flight Mass Spectrometry (MALDI-TOF) MS system. Embodiments were analysed in triplicate. Five analyses were conducted in positive mode over the following ranges; 50-1,000, 500-5,000, 3,000-12,000, 10,000-80,000 and 10,000-150,000 m/z. The biodegradable detergent compositions were screened in negative mode for each mass range. Commercial mass standard solutions or bovine serum albumin were used to calibrate the sample spectra. Mass standards were analyzed for each m/z range and were internally calibrated. The sample spectra were externally calibrated with adjacent mass standards. The MALDI profiles are given in Graphs 1-5.

Referring to Graphs 1, 2, 3, 4 and 5, it is observed that the biodegradable detergent composition has MALDI-TOF MS spectra in the m/z range from about 513.1 to about 2847.7 with peak mass value range from about 1375.8 m/z to about 2009.2 m/z as shown in Graphs 1-5.

2. Determination of the HLB Values

Hydrophile-Lipophile Balance (HLB) values is created by mixing 1.5 ml of emulsifiers with different ratios of Span 80 (HLB=4) to the biodegradable detergent composition in separate tubes as shown in Table-1. 27 ml of distilled water was added to all the tubes to obtain a solution. 1.5 ml of oil whose HLB value is 6 is added to the solution and shaked for 20 seconds. The tubes were incubated for 24 hours and the HLB value was calculated for the unknown sample using the formula:

Percent of Span 80 (%)×4 (HLB of Span 80)+Percent of Product (%)×Product HLB=6

The Product HLB=(6−Percent of Span 80 (%)×4)/Percent of Product (%))

TABLE 1

| SPAN 80 (%) | PRODUCT (%) | DISTILLED WATER (ml) | OIL (ml) |
|---|---|---|---|
| 100 (1.5 ml) | 0 (0 ml) | 27 | 1.5 |
| 85 (1.275 ml) | 15 (0.225 ml) | 27 | 1.5 |
| 84 (1.260 ml) | 16 (0.240 ml) | 27 | 1.5 |
| 83 (1.245 ml) | 17 (0.255 ml) | 27 | 1.5 |
| 82 (1.230 ml) | 18 (0.270 ml) | 27 | 1.5 |
| 81 (1.215 ml) | 19 (0.285 ml) | 27 | 1.5 |
| 80 (1.200 ml) | 20 (0.300 ml) | 27 | 1.5 |
| 65 (0.970 ml) | 35 (0.530 ml) | 27 | 1.5 |
| 46 (0.690 ml) | 54 (0.810 ml) | 27 | 1.5 |
| 28 (0.420 ml) | 72 (1.08 ml) | 27 | 1.5 |
| 9 (0.135 ml) | 91 (1.365 ml) | 27 | 1.5 |
| 0 (0 ml) | 100 (1.5 ml) | 27 | 1.5 |

Suppose the stable emulsion is found to be 84%: 16% the HLB value was calculated using the formula 84%*4+16%*Product HLB=6

Product HLB=6−(84/100*4)/16/100

Product HLB=16.5

3. Emulsification Assay (E 24)

A series of test tubes are taken with 4 ml of sample and 4 ml of petrol to obtain a solution. The solution is vortexed for 2 minutes and allowed to stand for 24 hours. The E24 is given as the percentage of height of the emulsified layer (mm) divided by the total height of the liquid column (mm). 3.5 ml of water, 0.5 ml of TritonX100 and 4 ml of petrol are added to the control tubes.

The average was calculated for the control and the test and the E24 value was calculated from that.

For Illustration

If the average of control was 67.27 and the sample was 56.36

Emulsification assay (E 24)=100/67.27*56.36=83.7

4. Titratable Acidity Determination

Titratable acidity is the total organic acid content of given solution. Samples that are to be tested are suitably diluted to a ratio of 1:100 (0.5 ml sample in 50 ml of DI water) with de-ionized water. 20 μl (2-3 drops) of 1% phenolphthalein indicator is added to the diluted sample and mixed to obtain a solution. The solution is titrated against 0.1 N Sodium hydroxide (NaOH) until a faint pink colour is obtained. The amount of NaOH consumed was noted and used in the calculations as shown below.

Total Titratable Acidity $$TA\ \% = \frac{(\text{ml of NaOH consumed} * \text{normality of NaOH})}{(\text{total volume being titrated} * \text{dilution factor})} * 100$$

ml of NaOH→x ml
normality of NaOH→0.1 N
total volume being titrated→50 ml
dilution factor→$10^{-2}$ Titratable acidity with respect to lactic acid=total TA*0.009

90 is the molecular weight of Lactic acid.

The above examples provide illustrative representations of the effectiveness of the biodegradable detergent composition within the scope of the present invention. The present invention may be embodied in other specific forms without departing from its spirit or essential characteristics. The described embodiments are to be considered in all respects only as illustrative and not restrictive.

We claim:

1. A biodegradable detergent composition, comprising:
at least one bio surfactant;
at least one polyol;
at least one biopolymer;
at least one organic acid;
at least one essential oil; and
at least one stabilizer,
wherein the biodegradable detergent composition has a pH value of less than about 3.60, titratable acidity % between about 9.0-12.0, HLB value between about 14 to about 16.5, E24 value between about 73 and about 79.

2. The biodegradable detergent composition as claimed in claim 1, wherein said biodegradable detergent composition has a MALDI-TOF MS spectra in the m/z range from about 513.1 to about 2847.7 with peak mass value range from about 1375.8 m/z to about 2009.2 m/z.

3. A method of washing a textile comprising contacting a textile with an effective amount of a biodegradable detergent composition according to claim 2.

4. A method of manufacturing the biodegradable detergent composition as claimed in claim 1, comprising:

fermenting at least one starting culture probiotic organism through a medium which contains an energy source, a fermentation enhancer, or an additive;

adding at least one emulsifier or detergent to the medium as a fermentation enhancer or additive;

adding at least one natural vegetable oil to the medium once the medium reaches a pH value of about 4.0 to obtain a fermented product;

mixing at least one essential oil, either alone or in combination along with the emulsifier or detergent, with the fermented product; and adding at least one stabilizer either alone or in combination with the fermented product, wherein the fermenting is continued until the desired value of pH, titratable acidity, HLB value and E24 values are obtained, wherein the emulsifier or detergent is added in the range of about 0.05 to about 0. 15%, wherein the natural vegetable oil is added in the range of about 0.05 to about 5% of the total volume of broth, and wherein the stabilizer is added at a concentration of about 0.5 to about 3.0%.

5. The method as claimed in claim 4, wherein the probiotic organism includes at least one species of microorganism selected from the group consisting of lactic acid, probiotic, phototrophic, and sulfide-utilizing microorganisms species.

6. The method as claimed in claim 5, wherein the sulfide-utilizing microorganism is a purple non-sulfur bacteria species.

7. The method as claimed in claim 6, wherein the purple non-sulfur bacteria species comprises a Rhodopseudomonas species.

8. The method as claimed in claim 4, wherein the energy source, fermentation enhancer or additive comprises one or more of fruit juice, unrefined cane sugar, beet sugar, molasses or other natural sugar source, emulsifier or detergent, or the natural vegetable oil.

9. The method as claimed in claim 4, wherein the essential oil is mixed with the fermented product in the range of about 0.05 to about 5% of the total volume of the broth.

10. The method as claimed in claim 4, wherein the essential oil comprises one or more of lavender oil, lemon oil, or lemon grass oil.

11. The method as claimed in claim 4, wherein the fermenting is carried out at a temperature ranging from about 17° C. to about 45° C. for a period of 14-42 days.

12. The biodegradable detergent as claimed in claim 1 further comprising at least one live microorganism and at least one enzyme.

13. A method of washing a textile comprising contacting a textile with an effective amount of a biodegradable detergent composition according to claim 12.

14. A method of washing a textile comprising contacting a textile with an effective amount of a biodegradable detergent composition according to claim 1.

15. A biodegradable detergent composition comprising:

at least one bio surfactant;

at least one polyol;

at least one biopolymer;

at least one organic acid;

at least one essential oil; and at least one stabilizer, wherein the biodegradable detergent composition has a pH value of less than about 3.60 and an HLB value between about 14 to about 16.5.

16. The biodegradable detergent composition as claimed in claim 15 with an E24 value between about 73 and about 79.

17. A method of washing a textile comprising contacting a textile with an effective amount of a biodegradable detergent composition according to claim 16.

18. The biodegradable detergent composition as claimed in claim 15 or 16 further comprising at least one purple non-sulfur bacteria species.

19. A method of washing a textile comprising contacting a textile with an effective amount of a biodegradable detergent composition according to claim 18.

20. A method of washing a textile comprising contacting a textile with an effective amount of a biodegradable detergent composition according to claim 15.

* * * * *